US007980110B2

(12) United States Patent
Hawkes

(10) Patent No.: US 7,980,110 B2
(45) Date of Patent: Jul. 19, 2011

(54) CONTINUOUS EXTRUSION APPARATUS

(75) Inventor: Daniel J. Hawkes, Shadoxhurst (GB)

(73) Assignee: BWE Limited, Kent (GB)

( * ) Notice: Subject to any disclaimer, the term of this patent is extended or adjusted under 35 U.S.C. 154(b) by 937 days.

(21) Appl. No.: 11/785,922

(22) Filed: Apr. 20, 2007

(65) Prior Publication Data

US 2008/0118595 A1 May 22, 2008

Related U.S. Application Data

(63) Continuation of application No. PCT/GB2005/004048, filed on Oct. 20, 2005.

(30) Foreign Application Priority Data

Oct. 20, 2004 (GB) ..... 0423222.9

(51) Int. Cl.
*B21C 23/00* (2006.01)
*B21C 25/02* (2006.01)
*B21D 37/16* (2006.01)

(52) U.S. Cl. ..... 72/262; 72/268; 72/342.7

(58) Field of Classification Search ..... 72/262, 72/258, 273.5, 342.1, 342.7, 282, 289, 271, 72/263, 342.92, 268
See application file for complete search history.

(56) References Cited

U.S. PATENT DOCUMENTS 2,105,083 A * 1/1938 Kagi et al. ..... 72/18.3
2,869,220 A 1/1959 Raydt et al.
3,572,074 A 3/1971 Holdup et al.
3,732,717 A 5/1973 Ahlvers
4,564,347 A * 1/1986 Vaughan ..... 425/79
5,152,163 A 10/1992 Hawkes et al.
5,197,319 A 3/1993 Beekel et al.
5,464,340 A * 11/1995 Yano ..... 425/382.3
5,829,298 A 11/1998 Linsenbardt et al.
5,836,191 A * 11/1998 Wright ..... 72/262
6,209,618 B1 * 4/2001 Chiang ..... 164/338.1
6,988,389 B2 1/2006 Hawkes
7,194,885 B2 3/2007 Hawkes
(Continued)

FOREIGN PATENT DOCUMENTS

EP 0 202 953 A2 11/1986
(Continued)

OTHER PUBLICATIONS

Written Opinion of the International Searching Authority of PCT/GB2008/001754 dated Aug. 11, 2008, 8 pgs.

(Continued)

*Primary Examiner* — Debra M Sullivan
(74) *Attorney, Agent, or Firm* — Shlesinger, Arkwright & Garvey LLP

(57) ABSTRACT

Apparatus for continuous extrusion of an aluminium sheathing free from imperfections or discontinuities onto a core cable, such as an insulated copper cable, includes a rotatable wheel formed with a pair of circumferential grooves arcuate tooling bounding radially outer portions of the respective grooves, a die body provided with divergent exit apertures discharging laterally to an extrusion chamber through 90° elbows and short divergent passages at diametrically opposed locations. An electrical induction heater includes coils of copper tubing connected to an electrical power source and to a coolant circulating device is positioned at a radially outer portion of the die body and is energizable to supply heat to the die body to maintain a uniform temperature of approximately 480° C., controlled by signals from thermocouples around the extrusion chamber.

5 Claims, 5 Drawing Sheets

U.S. PATENT DOCUMENTS

| | | | | |
|---|---|---|---|---|
| 2002/0189313 | A1 * | 12/2002 | Plata et al. | 72/272 |
| 2005/0268682 | A1 | 12/2005 | Hawkes | |
| 2006/0156782 | A1 | 7/2006 | Hawkes | |
| 2008/0118595 | A1 | 5/2008 | Hawkes | |

FOREIGN PATENT DOCUMENTS

| | | | |
|---|---|---|---|
| WO | WO 2006/043069 | A | 4/2006 |

OTHER PUBLICATIONS

International Search Report of PCT/GB2008/001754 dated Aug. 11, 2008, 3 pgs.

Publication No. JP 56139222 A, dated Oct. 30, 1981, English Abstract of JP 59011366 B, (1 pg.).

* cited by examiner

CONTINUOUS EXTRUSION APPARATUS

CROSS-REFERENCE TO RELATED APPLICATIONS

This application is a continuation of application No. PCT/GB2005/004048, filed Oct. 20, 2005, which claims the priority of United Kingdom application no. 0423222.9, filed 20 Oct. 2004, and each of which is incorporated herein by reference.

FIELD OF THE INVENTION

This invention relates to continuous extrusion apparatus for continuously extruding a sheath around a core cable.

BACKGROUND OF THE INVENTION

EP-A-0125788 discloses continuous extrusion apparatus having a rotatable wheel formed with two identical circumferential grooves, arcuate tooling bounding radially outer portions of the respective grooves, a die body provided with exit apertures extending in a generally radial direction from the respective grooves to an extrusion chamber positioned around a portal mandrel and discharging axially of the mandrel through a die orifice of uninterrupted annular cross-section intermediate the mandrel and a die body wall and a device is provided arranged to supply a core through the mandrel.

OBJECTS AND SUMMARY OF THE INVENTION

It is an object of the invention to overcome the drawbacks of the prior art.

It is another object of the invention to provide a continuous extrusion apparatus for continuously extruding a sheath around a core cable which works better than prior art continuous extrusion apparatuses.

According to the present invention, a heating device is provided arranged to supply heat to a portion of the die body radially outward of the wheel from the extrusion chamber.

Preferably, the heating device includes electric induction heating coils. The coil may be positioned on the die body.

Suitably, thermocouples are provided at locations in the die body radially inwardly and outwardly of the wheel from the extrusion chamber and are connected to provide a signal utilisable to regulate input of heat from the heating device to maintain a substantially uniform temperature in the die body around the extrusion chamber.

Desirably, the die body is a removable sliding fit in a pocket formed in a shoe pivotable into contact with the rotatable wheel.

Advantageously, the exit apertures extending in a generally radial direction from the respective circumferential grooves connect laterally at diametrically opposed locations into the extrusion chamber through 90° elbows and short passages extending tangential to the rotatable wheel. The exit apertures may be of divergent cross-section in the direction of flow.

With further advantage, the arcuate tooling is mounted on the die body and is positionable against the rotatable wheel by way of a pressure yoke arranged to bear against a face of the die body radially outward of the rotatable wheel. A pair of abutments obturating the respective circumferential grooves may be mounted to be moveable in a direction tangential to the rotatable wheel in to or out from the circumferential grooves in sliding contact with an associated face of the die body adjoining the rotatable wheel. The die body may be located against a stop provided on a framework supporting the rotatable wheel, a pivot carrying the pressure yoke and a ram arranged to apply an adjustable force to the pressure yoke urging the die body toward the stop.

The invention includes an apparatus for continuous extrusion of an aluminium sheathing free from imperfections or discontinuities on to a core cable such as an insulated copper cable includes a rotatable wheel formed with a pair of circumferential grooves arcuate tooling bounding radially outer portions of the respective grooves, a die body provided with divergent exit apertures discharging laterally to an extrusion chamber through 90° elbows and short divergent passages at diametrically opposed locations. An electrical induction heater includes coils of copper tubing connected to an electrical power source and to a coolant circulating device is positioned at a radially outer portion of the die body and is energizable to supply heat to the die body to maintain a uniform temperature of approximately 480° C., controlled by signals from thermocouples around the extrusion chamber. The die body carries the arcuate tooling and is located against flanges on side frames supporting the rotatable wheel and a pivot of a pressure yoke bearing against an outer face of the die body. The die body is held in contact with the flanges by way of an adjustable force applied to the pressure yoke by a hydraulic ram. Abutments held in sliding contact with a radially inner face of the die body obturate the circumferential grooves to cause aluminium rod feedstock supplied to the grooves to discharge through the exit apertures upon rotation of the wheel. The exit apertures discharge the aluminium feed through the 90° elbows into the extrusion chamber where the flows mix and discharge as a sheath through the annular extrusion orifice on to the core cable fed through the portal mandrel over an adjustable guide roller.

Relative terms such as left, right, up, and down are for convenience only and are not intended to be limiting.

The invention will now be described, by way of example, with reference to the accompanying, partly diagrammatic, drawings.

DETAILED DESCRIPTION OF THE INVENTION

Figure 1:
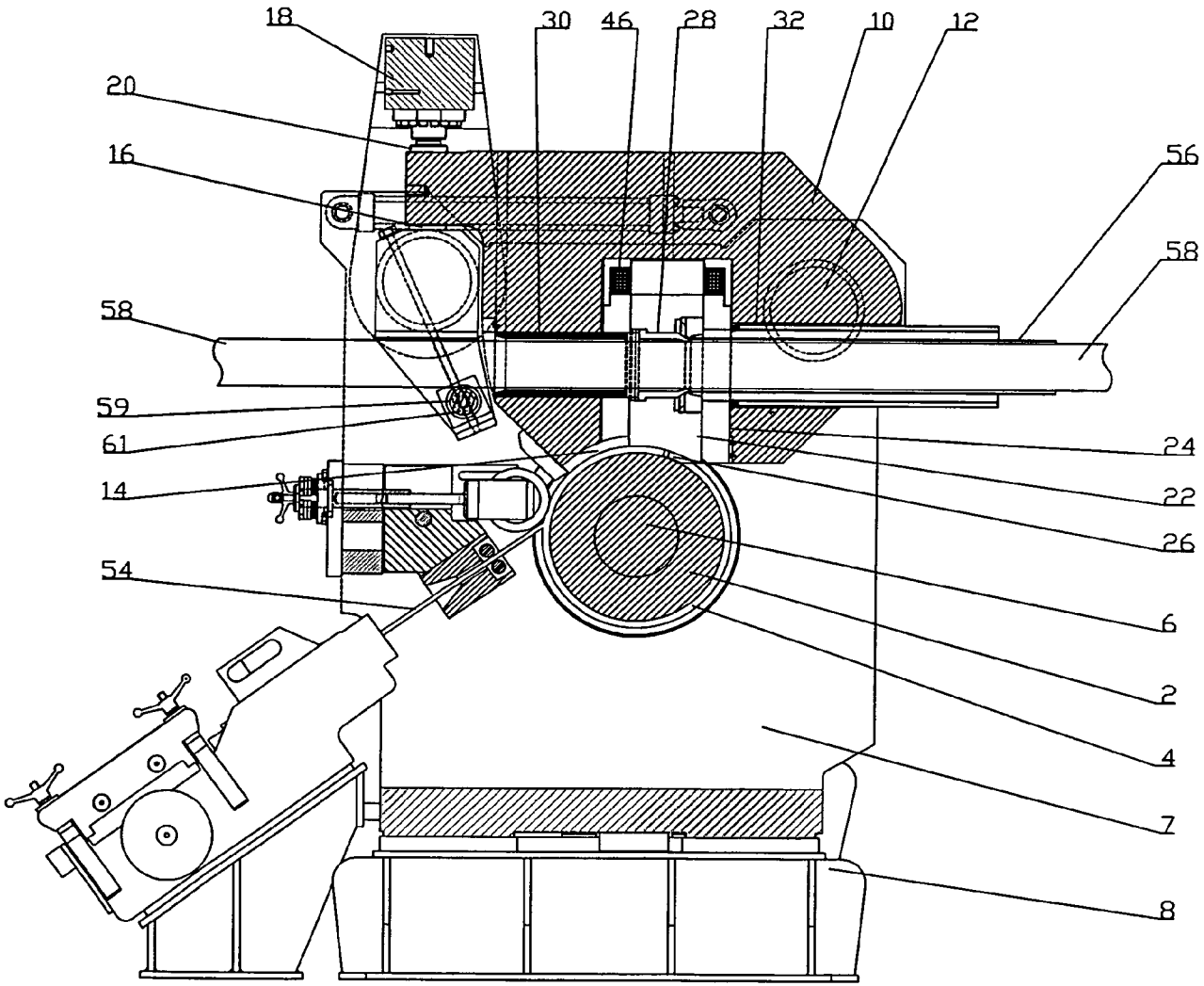
FIG. 1 is a cross-sectional side elevation of an embodiment of a continuous extrusion apparatus according to the invention with a die body portion shown in outline.

As shown, the continuous extrusion apparatus includes a rotatable wheel 2 provided with a pair of circumferential grooves 4 and is mounted on a horizontal drive shaft 6 running in bearings (not shown) positioned in side frames 7 mounted on a base 8. A shoe 10 mounted on a pivot 12 extending intermediate the side frames 7 and parallel to the horizontal drive shaft 6 carries arcuate tooling 14 registering with the respective grooves 4 and is urged against a stop 16 positioned adjacent the wheel 2 and above the drive shaft 6 by way of a hydraulic ram 18 bearing against a shoulder 20 formed on the shoe 10.

A die body 22, of rectangular cross-section, is removably seated in a pocket 24 formed in the shoe 10 and is provided with a pair of abutments 26 arranged to register with, and obturate, the respective grooves 4. A stepped passage 28 in the die body 22 registers with passages 30, 32 penetrating the shoe 10 and extending in a direction tangential to the wheel 2.

Exit apertures 34 extending generally radially from the respective grooves 4 and of divergent cross-section connect laterally at diametrically opposed locations 35 into an extrusion chamber 36 through 90° elbows 37 and short divergent, passages 39 extending in a direction tangential to the wheel 2. The open end of the extrusion chamber 36 is provided with a guide ring 38 and a die ring 40 seating on a face on the die body 22. A cylindrical, tubular, mandrel 42 is seated on a step 43 in the passage 28 and co-acts with the die ring 40 to form an annular extrusion orifice 44.

Coils 46 of an electrical induction heater consisting of copper tubing connected to a coolant circulating pump (not shown) and a source of electrical power (not shown) are positioned at a radially outer end portion 48 of the die body 22. Thermocouples 50, 52 are positioned in the die body 22 radially inwardly and outwardly of the extrusion chamber 36 and are connected through electrical conductors (not shown) to a control circuit (not shown) regulating energization of the induction heater coils 46.

In operation, to form an aluminium sheath 56 on a core cable 58, such as a copper conductor clad with insulating material, having a diameter in the range of 50 mm to 200 mm, preparatory to commencing extrusion the die body 22 is removed from the shoe and heated to a temperature approximating to the desired extrusion temperature of approximately 480-500° C. The die body 22 is then re-positioned in the pocket 24, the shoe 10 pivoted into contact with the wheel 2 and the hydraulic ram 18 actuated to apply force to the shoe. A drive (not shown) connected to the drive shaft 6 is energised and aluminium rod feedstock 54 fed into the grooves 4, which, by virtue of the frictional forces generated between the aluminium feedstock, the walls of the grooves, the arcuate tooling 14 and the abutments 26, is brought to a plastic state and flows through the exit apertures 34 to the extrusion chamber 36 as a continuous extrusion process. The flows from the respective exit apertures 34 combine in the extrusion chamber 36 and extrude through the annular extrusion orifice 44 to produce the continuous sheath 56 for the core cable 58 fed over a guide roller 59 mounted on an eccentric shaft 61 adjustable in order that the core cable 58 is supplied substantially co-axially of the mandrel 42. A substantially uniform temperature of approximately 500° C. is maintained in the die body 22 around the extrusion chamber 36 by augmenting the heat input arising from the frictional forces transmitted to the radially inner portion 49 with a heat input generated by energising the electrical induction heater coils 46 transmitted to the radially outer portion 48. Output signals from the thermocouples 50, 52 are utilised to regulate energization of the coils 46 to achieve the required heating of the die body 22. By maintaining a substantially uniform temperature around the extrusion chamber 36 free flow and mixing of the two flows from the exit apertures 34 is achieved thereby producing sound sheathing free from imperfections or discontinuities.

Upon exit from the continuous extrusion apparatus, the sheath 56 is subjected to rapid cooling in order to limit any deleterious effects of heat on the insulating cladding material of the core cable 58. A roller corrugator (not shown) is positioned downstream of the continuous extrusion apparatus to form a spiral corrugation in the sheath 56 contacting the core cable 58.

It will be appreciated that, whilst in the foregoing description, the continuous extrusion apparatus is arranged such that the core cable 58 is fed in a horizontal direction, the arrangement may be rotated through 90° such that the core cable is fed in a vertical direction, thereby facilitating co-axial alignment of the core cable and the sheath during extrusion.

It will also be appreciated that mixing and combining flows of aluminium in the extrusion chamber 36 may be enhanced by grooving and shaping the wall surfaces of the extrusion chamber.

It will further be appreciated that the electric induction heater coils 46 may be positioned in the shoe.

Figure 3:
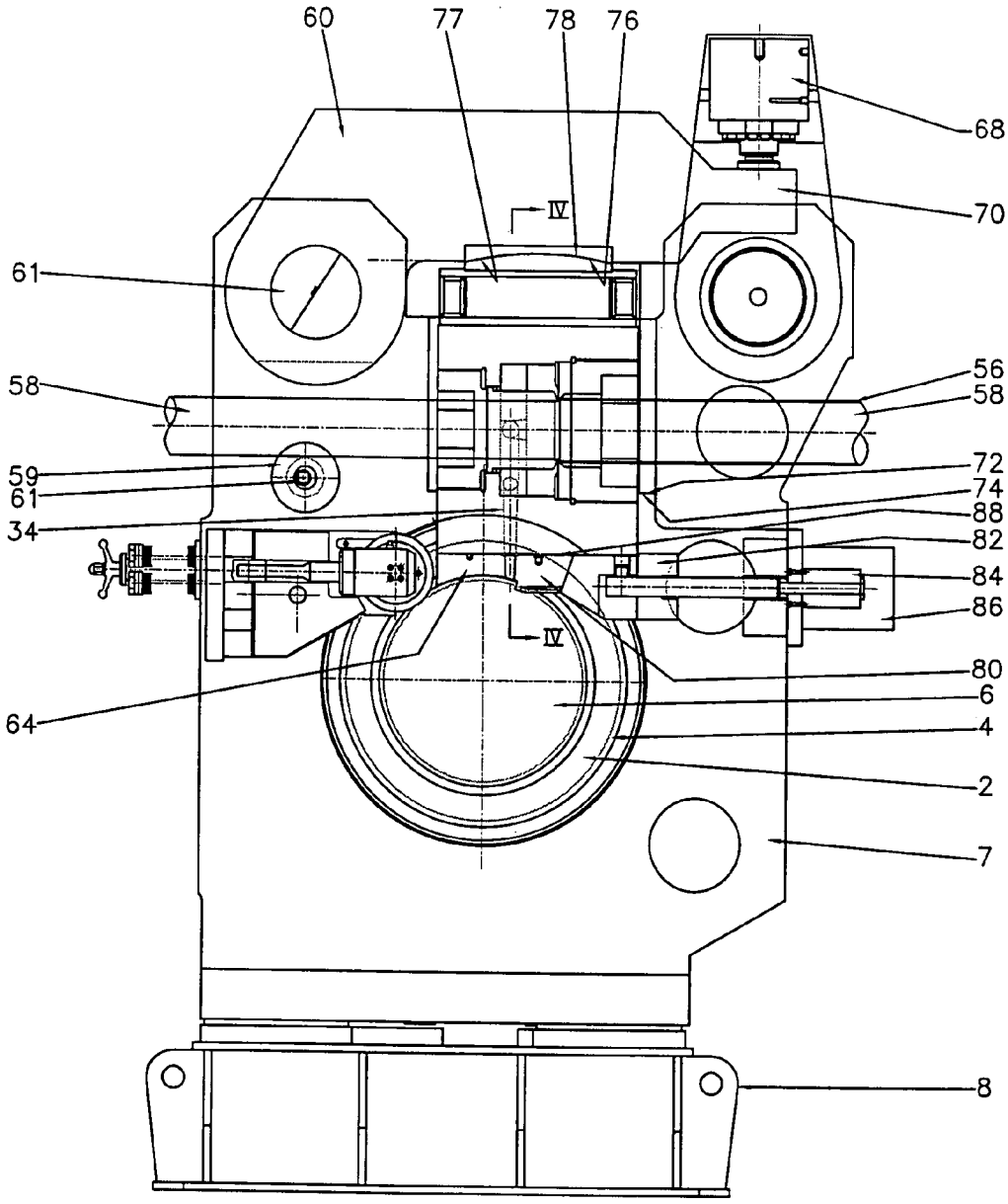
FIG. 3 is a cross-sectional side elevation of an alternative arrangement of an embodiment of a continuous extrusion apparatus according to the invention.
Figure 4:
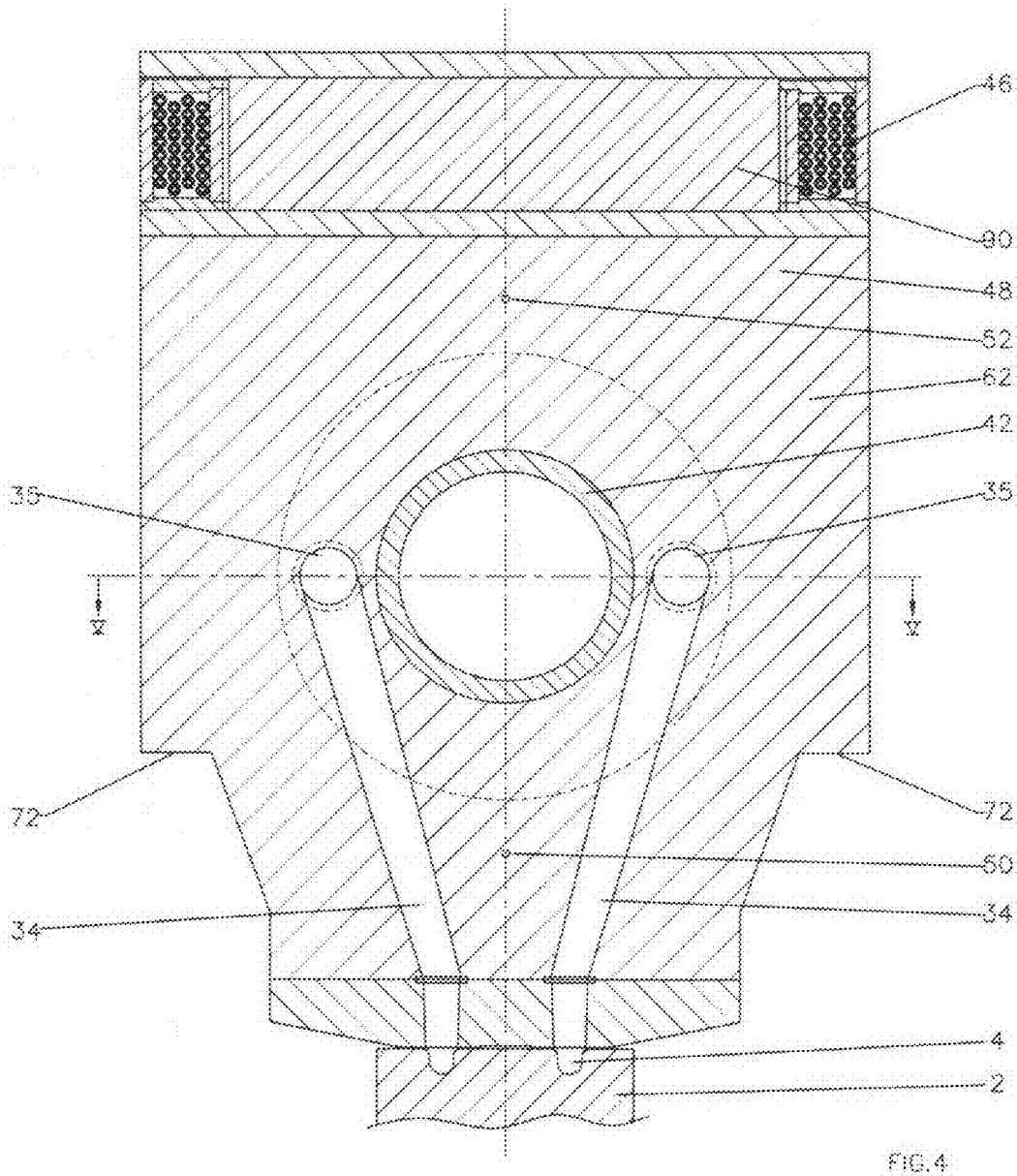
FIG. 4 is a cross-sectional end elevation of a die body portion taken on the line IV-IV of FIG. 3.
Figure 5:
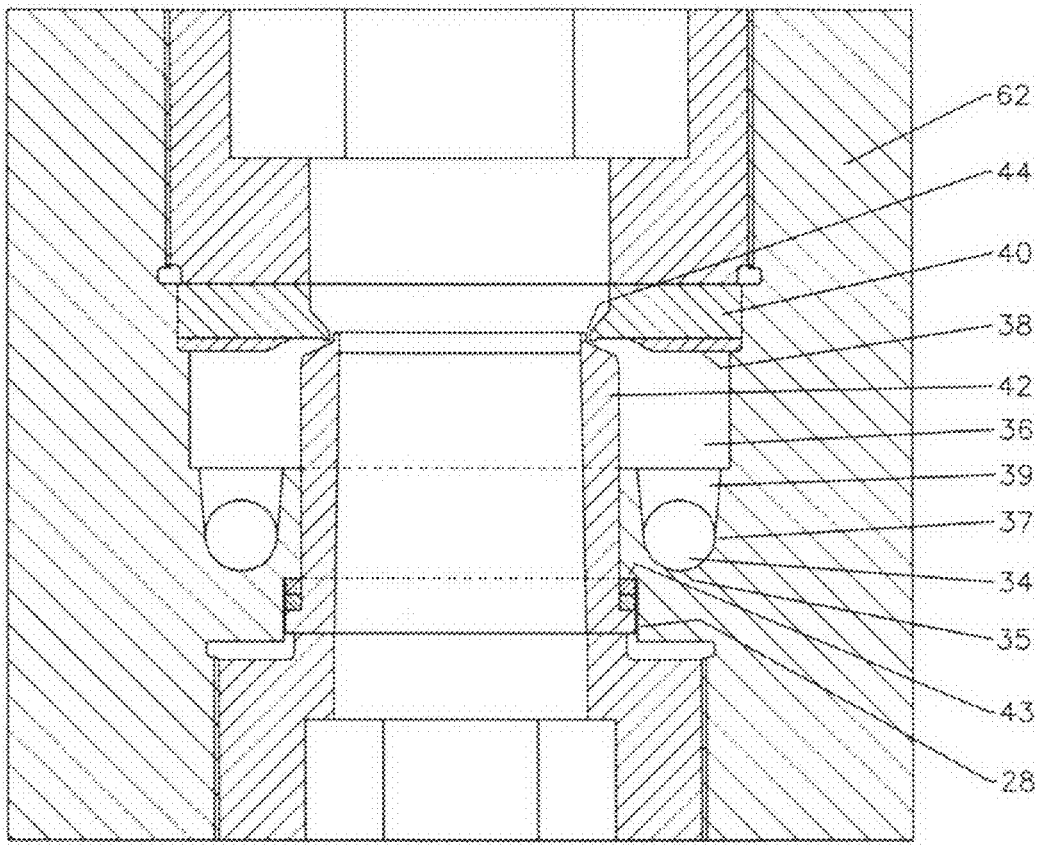
FIG. 5 is a cross-sectional plan view of the die body portion taken on the line V-V of FIG. 4.

In the arrangement shown in FIGS. 3 to 5, the rotatable wheel 2 provided with the pair of circumferential grooves 4 is mounted on the horizontal drive shaft 6 running in bearings (not shown) positioned in the side frames 7 mounted on the base 8. A pressure yoke 60 mounted on a pivot 61 extending intermediate the side frames 7 and parallel to the horizontal drive shaft 6 co-acts with a die body 62 carrying arcuate tooling 64 registering with the respective grooves 4. The pressure yoke 60 is urged towards the wheel 2 by way of a hydraulic ram 68 bearing against a shoulder 70 formed on the pressure yoke 60.

The die body 62, of rectangular cross-section, is removably located intermediate the side frames 7 and is formed with a stepped portion 72 arranged to seat on flanges 74 provided on the side frames 7. A radially outer head portion 76 is formed with a curved face 77 co-acting with a curved face 78 recessed into the pressure yoke 60 to facilitate transmission of pressure loading exerted by the hydraulic frame 68 through the pressure yoke 60 to the head portion 76.

A pair of abutments 80 are positioned on a carriage 82 slidably mounted on the side frames 7 and are movable in to and out from the respective grooves 4 by way of an actuating, hydraulic, ram 84 extending between the carriage 82 and a fixed mounting 86 on the side frames 7. The abutments 80 have associated faces which slidably contact faces 88 on a radially inner portion of the die body 62 such that the abutments 80 are held in position obturating the grooves 4 by virtue of the forces applied by way of the hydraulic ram 68, acting through the pressure yoke 60 and die body 62 and the actuating, hydraulic, ram 84 acting through the carriage 82.

Exit apertures 34 extending generally radially from the respective grooves 4 and of divergent cross-section connect laterally at diametrically opposed locations 35 into an extrusion chamber 36 through 90° elbows 37 and short divergent, passages 39 extending in a direction tangential to the wheel. The open end of the extrusion chamber 36 is provided with a guide ring 38 and a die ring 40 seating on a face on the die body 62. A cylindrical, tubular, mandrel 42 is seated on a step 43 in the passage 28 and co-acts with the die ring 40 to form an annular extrusion orifice 44.

Coils 46 of an electrical induction heater consisting of copper tubing connected to a coolant circulating pump (not shown) and a source of electrical power (not shown) are positioned at a radially outer end portion 48 of the die body 62. Thermocouples 50, 52 are positioned in the die body 62 radially inwardly and outwardly of the extrusion chamber 36 and are connected through electrical conductors (not shown) to a control circuit (not shown) regulating energization of the induction heater coils 46.

Figure 2:
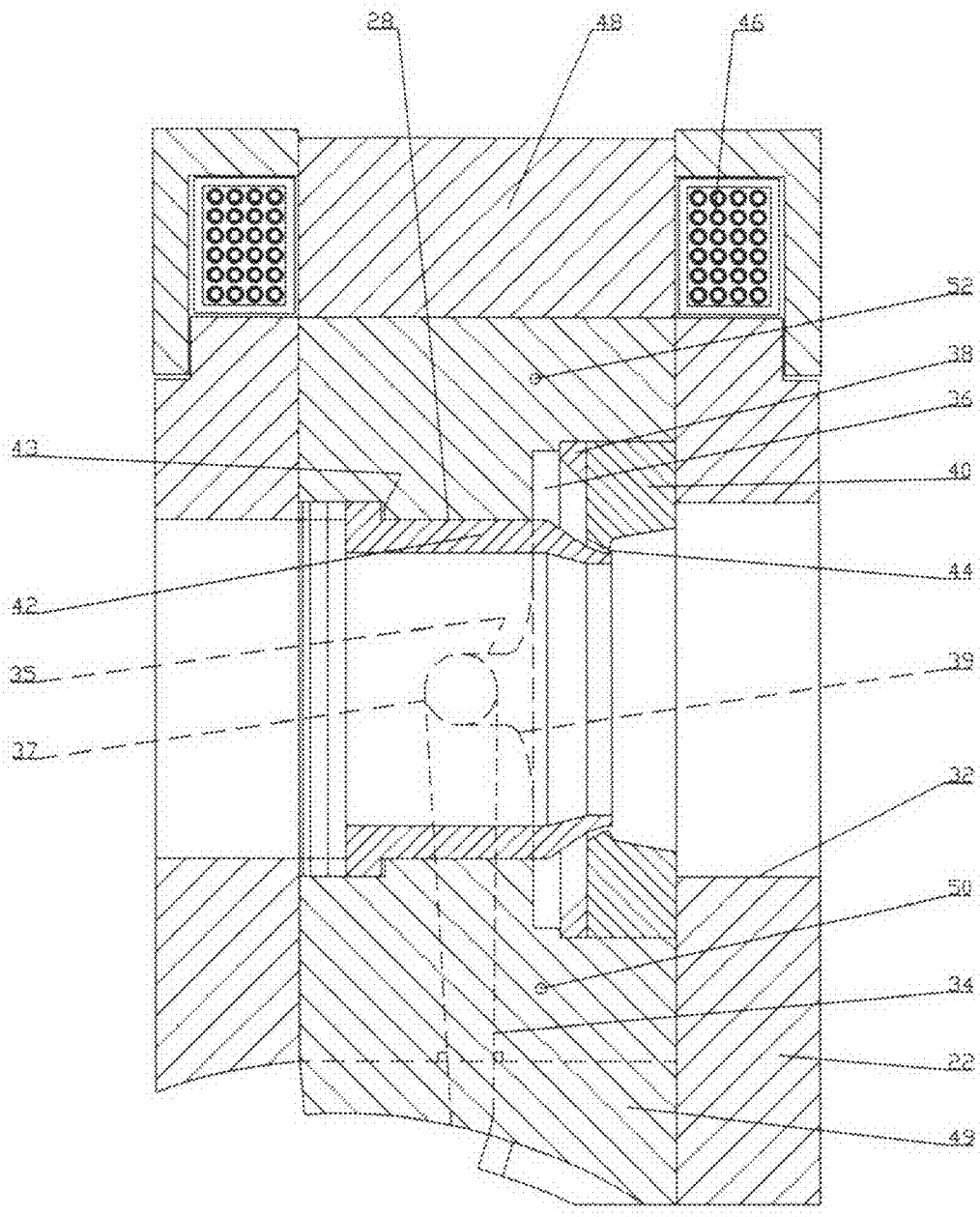
FIG. 2 is the die body, a portion of FIG. 1, on an enlarged scale, omitting feed material.

In operation, the apparatus described in conjunction with FIGS. 3 to 5 functions in a manner similar to the operation of the apparatus described in conjunction with FIGS. 1 and 2.

Positioning the stepped portion 72 of the die body 22 on the flanges 74 on the side frames 7 enables the spacing between the die body 22 together with the arcuate tooling 64 and the abutments 80 to be maintained within close limits despite overall thermal expansion of the die block 62 during operation arising from the high temperatures approaching 500° C., occurring.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. Continuous extrusion apparatus, comprising:

a) a rotatable wheel provided and formed with two identical circumferential grooves;

b) arcuate tooling provided and bounding radially outer portions of the respective grooves;

c) a die body provided and including exit apertures extending in a generally radial direction from the respective grooves to an extrusion chamber positioned around a portal mandrel and discharging axially of the mandrel through a die orifice of uninterrupted annular cross-section intermediate the mandrel and a die body wall;

d) a supply device provided and arranged to supply a core through the mandrel, in use;

e) a heating device provided and arranged to supply heat to a portion of the die body radially outward of the wheel from the extrusion chamber, in use;

f) the heating device including electric induction heating coils;

g) the coils being positioned on the die body;

h) a pair of abutments obturating the respective circumferential grooves are mounted to be moveable in a direction tangential to the rotatable wheel into and out from the circumferential grooves in sliding contact with an associated face of the die body adjoining the rotatable wheel with the die body in contact with the adjoining rotatable wheel; and i) a ram being provided for moving the abutments into and out from the circumferential grooves for obturating the respective circumferential grooves.

2. Continuous extrusion apparatus as claimed in claim 1, wherein:

a) thermocouples are provided at locations in the die body radially inwardly and outwardly of the wheel from the extrusion chamber and are connected to provide a signal utilizable to regulate input of heat from the heating device to maintain a substantially uniform temperature in the die body body around the extrusion chamber.

3. Continuous extrusion apparatus as claimed in claim 1, wherein:

a) the exit apertures extending in a generally radial direction from the circumferential grooves connect laterally at diametrically opposed locations into the extrusion chamber through 90° elbows and short passages extending tangential to the rotatable wheel.

4. Continuous extrusion apparatus as claimed in claim 3, wherein:

a) the short passages are of divergent cross-section in a direction of flow.

5. Continuous extrusion apparatus as claimed in claim 1, wherein:

a) the exit apertures are of divergent cross-section in a direction of flow.

* * * * *